US005195435A

United States Patent [19]

Morrone et al.

[11] Patent Number: 5,195,435

[45] Date of Patent: Mar. 23, 1993

[54] CONTINUOUS INTAGLIO PRINTING APPARATUS AND METHOD

[75] Inventors: Ross F. Morrone, Cranbury; Vincent E. Ciriello, Highlands, both of N.J.; Jack D. Stewart, Doylestown, Pa.

[73] Assignee: All-State Legal Supply Co., Cranford, N.J.

[21] Appl. No.: 670,987

[22] Filed: Mar. 18, 1991

[51] Int. Cl.[5] ..... B41F 9/02; B41F 9/14

[52] U.S. Cl. ..... 101/151; 101/164; 101/170

[58] Field of Search ..... 101/151, 163, 164, 165, 101/166, 168, 193, 196, 197, 198, 199, 288, 290, 292, 293, 316, 170; 83/209, 71

[56] References Cited

U.S. PATENT DOCUMENTS

| | | | |
|---|---|---|---|
| 1,102,770 | 7/1914 | Lockwood | 101/164 |
| 1,271,965 | 7/1918 | Waldron | 101/163 |
| 1,423,589 | 7/1922 | Wood | 101/163 |
| 1,469,737 | 10/1923 | Tevander | 101/199 |
| 1,878,565 | 9/1932 | Woodbury | 101/163 |
| 1,960,513 | 5/1934 | Rosenthal . | |
| 2,037,091 | 4/1936 | Rosenthal . | |
| 2,623,457 | 12/1952 | Gabbert . | |
| 2,745,186 | 5/1956 | Faeber | 101/DIG. 36 X |
| 3,848,528 | 11/1974 | Seedorf . | |
| 4,706,565 | 11/1987 | Martin | 101/164 X |

OTHER PUBLICATIONS

"Automated Die-Cutting and Stamping Systems", Preco Industries, Inc.

"Roll Feed Systems with Microprocessor Control", Preco Industries, Inc.

*Primary Examiner*—J. Reed Fisher

*Attorney, Agent, or Firm*—Lerner, David, Littenberg, Krumholz & Mentlik

[57] ABSTRACT

A continuous multi-station intaglio printing system enables use of a continuous web of letterhead paper or business card stock to which various indicia of single of multiple colors may be engraved in precise registration and subsequently severed or die cut into individual sheets of letterhead paper or business cards of regular or irregular shape. Each engraving station includes a hydraulic press to perform the engraving operation by means of an engraving die. The engraving die is removably mounted to a support using aligned pins and openings to effect precise registration of the engraving die. Registration of the engraving die, as well as a cutting die, may be precisely obtained with respect to the indicia on the engraved web material using a photo optic sensor for detecting a registration mark on the web material. Precision multi-colored engraving, as well as precision die cutting of the web material may be obtained in a multi-station intaglio printing system.

49 Claims, 8 Drawing Sheets

CONTINUOUS INTAGLIO PRINTING APPARATUS AND METHOD

BACKGROUND OF THE INVENTION

The present invention relates in general to the field of intaglio printing and engraving, and more particularly, to a continuous intaglio printing apparatus and multi-station system enabling the use of a continuous web of material, e.g., letterhead paper or business card stock, to which various indicia of single or multiple colors is engraved on registered portions of the web prior to severing or die cutting into individual sheets of letterhead paper or business cards of regular or irregular shape.

As used herein, the terms intaglio and engraving are intended to have the same meaning and are therefore used interchangeably. The conventional practice in the intaglio printing and engraving art is to engrave print paper or card stock in individual precut pieces. The process of intaglio printing or engraving is generally performed in a single die stamping operation, such as known from Gabbert, U.S. Pat. No. 2,623,457. However, it is also known that multiple engravings can be achieved in a single die stamping operation. In this regard, multiple engraving operations almost always require secondary cutting operations which result in increased costs and the creation of additional process operations where errors can occur, resulting in a higher percentage of product rejection. When there is a requirement for engraving more than one color, or providing some form of embossing and foil, additional passes through the engraving press are necessary, again resulting in additional processing operations that increase costs and rejects. It is not surprising that the standard engraving art makes color registration during additional passes very difficult and heavily dependent upon the skill of the operator.

One advance in the intaglio printing and engraving art is the design of engraving presses which accommodate the use of a continuous web of paper or card stock which is subsequently severed into single engraved sheets or cards. Conventional engraving presses of this type are known from Rosenthal, U.S. Pat. No. 1,960,513 and Rosenthal, U.S. Pat. No. 2,037,091. Once again, these engraving presses require added process operations that increase costs and rejects when required to perform additional passes through the engraving press, for example, in multi-colored engraving. In addition, the same scenario occurs when additional passes are required for separately engraving various portions of the paper or card stock which cannot be achieved using a single engraving die. One can appreciate that the known intaglio printing and engraving art has yet to address the problems associated with multiple engraving operations and the requirement for precise registration of the paper or card stock with the engraving die.

The known engraving presses are constructed to provide the intermittent movement of the engraving die by the press ram using mechanical action. Mechanical presses although having been used in the engraving art for many years, possess a number of inherent disadvantages. In particular, mechanical presses are frequently slow due to their long operating stroke which often cannot be adjusted. Dwell time, i.e., the time the engraving die is maintained in pressure contact with the paper or card stock, is not an operating variable of a mechanical press. That is, the mechanical linkage results in an instantaneous contact force being applied by the engraving die into the paper or card stock as the linkage goes through its operating stroke. However, due to the properties of certain printing inks and absorption characteristics of certain paper or card stocks, it may be desirable to have a dwell time to enhance the transfer of the printing ink from the engraving die onto the paper or card stock.

As mechanical presses bottom out after the top of their operating stroke, unless the linkage is properly adjusted, there is a tendency for these presses to lock up thereby interrupting the engraving process. This tendency is increased when it is desired to adjust the ram force by changing the spaced distance between the ram and the stationery platen. If the resulting space is not sufficient to enable the linkage to go through its full cycle, the press will lock up. Thus, there have been substantial unmet needs in the intaglio printing and engraving art in providing a continuous multi-station intaglio printing system, apparatus and method therefor which address and overcomes the above problems with a high degree of repeatability and control which has heretofore been unknown.

SUMMARY OF THE INVENTION

An object of the present invention is to provide an intaglio printing apparatus adapted for use in a continuous multi-station intaglio printing system and method therefor to enable engraving on a continuous web of paper or card stock.

Another object of the present invention is to provide an intaglio printing apparatus adapted for use in a continuous multi-station intaglio printing system and method therefor operative for precisely controlling the advancement of the web within the engraving press at one or more stations.

Another object of the present invention is to provide an intaglio printing apparatus adapted for use in a continuous multi-station intaglio printing system and method therefor enabling multiple engraving operations to be performed in line, with two or more color engraving operations being easily sequentially performed with enhanced accurate registration with the respective engraving dies.

Another object of the present invention is to provide an intaglio printing apparatus adapted for use in a continuous multi-station intaglio printing system and method therefor enabling embossing or foil stamping process operations in line.

Another object of the present invention is to provide an intaglio printing apparatus adapted for use in a continuous multi-station intaglio printing system and method therefor enabling die cutting process operations in line at a downstream process location.

Another object of the present invention is to provide an intaglio printing apparatus adapted for use in a continuous multi-station intaglio printing system and method therefor which provides a complete intaglio printing system, from continuous roll stock, to finished product.

Another object of the present invention is to provide an intaglio printing apparatus adapted for use in a continuous multi-station intaglio printing system and method therefor which enables the effective use of die cutting process operations designable for multiple products, for example, business cards, announcements and irregular shaped products by a quick and easy change in tooling.

Another object of the present invention is to provide an intaglio printing apparatus adapted for use in a continuous multi-station intaglio printing system and method therefor which provides for enhanced registration of the web of paper or card stock with the engraving die or cutting die using optical feedback.

Another object of the present invention is to provide an intaglio printing apparatus adapted for use in a continuous multi-station intaglio printing system and method therefor which enables adjustable and precision pressure control of the hydraulic engraving press during each stroke of the engraving operation.

Another object of the present invention is to provide an intaglio printing apparatus adapted for use in a continuous multi-station intaglio printing system and method therefor which enables adjustable and precision dwell time of the hydraulic engraving press during each stroke of the engraving operation.

Another object of the present invention is to provide an intaglio printing apparatus adapted for use in a continuous multi-station intaglio printing system and method therefor which enables quick and easy tooling changes between engraving operations.

Another object of the present invention is to provide an intaglio printing apparatus adapted for use in a continuous multi-station intaglio printing system and method therefor which enables in line use of a sheeting station for letterheads.

Another object of the present invention is to provide an intaglio printing apparatus adapted for use in a continuous multi-station intaglio printing system and method therefor which provides for segregation of die cut products at the die cutting station.

In accordance with one embodiment of the present invention, there is provided a continuous intaglio printing apparatus constructed of a hydraulic press having an intermittently moveable ram, supply means for supplying a continuous web of material to the hydraulic press, and intaglio printing means in operative association with the ram for engraving the web of material upon intermittent movement of the ram by operation of the hydraulic press.

In accordance with another embodiment of the present invention there is provided a continuous multi-station intaglio printing system constructed of a hydraulic press having an intermittently movable ram at each of a plurality of engraving stations, supply means for supplying a continuous web of material successively to the hydraulic press at each of the plurality of engraving stations, intaglio printing means at each of the plurality of engraving stations in operative association with the ram for engraving the web of material at each the engraving station upon intermittent movement of the ram by operation of the hydraulic press.

In accordance with another embodiment of the present invention, there is provided a continuous multi-station intaglio printing system constructed of a hydraulic press having an intermittently movable ram at each of a plurality of engraving stations, supply means for supplying a continuous web of material successively to the hydraulic press at each of the plurality of engraving stations, and intaglio printing means at each of the plurality of engraving stations, and intaglio printing means at each of said plurality of engraving stations in operative association with the ram for engraving the web of material at each engraving station upon intermittent movement of the ram by operation of the hydraulic press, the intaglio printing means including first support means for removably supporting an engraving die underlying the ram and second supporting means for removably supporting a die-counter in opposed spaced relationship to the engraving die, application means for applying printing fluid to the engraving die, means for supplying a continuous web of wiper material for wiping excess printing fluid from the engraving die, a pair of nip rollers engageable on opposite sides of the web of wiper material for advancement thereof upon rotation of at least one of the rollers, rotation means for rotating at least one of the rollers, severing means for severing the web of material into individual pieces of engraved material.

In accordance with another embodiment of the present invention, there is provided a continuous intaglio printing method including advancing a continuous web of material to be engraved through a plurality of engraving stations, each of plurality of engraving stations including a hydraulic press having an intermittently moveable ram and intaglio printing means in operative association with the ram for engraving a portion of the web of material, and intermittently moving the ram by operation of the hydraulic press.

BRIEF DESCRIPTION OF THE DRAWINGS

The above description, as well as further objects, features and advantages of the present invention will be more fully understood with reference to the following detailed description of a continuous multi-station intaglio printing system, apparatus and method, when taken in conjunction with the accompanying drawings, wherein:

FIG. 10 is a diagrammatic illustration showing a rotary cutter for severing the web of paper into individual sheets of letterhead paper and the like;

DETAILED DESCRIPTION

Figure 1:
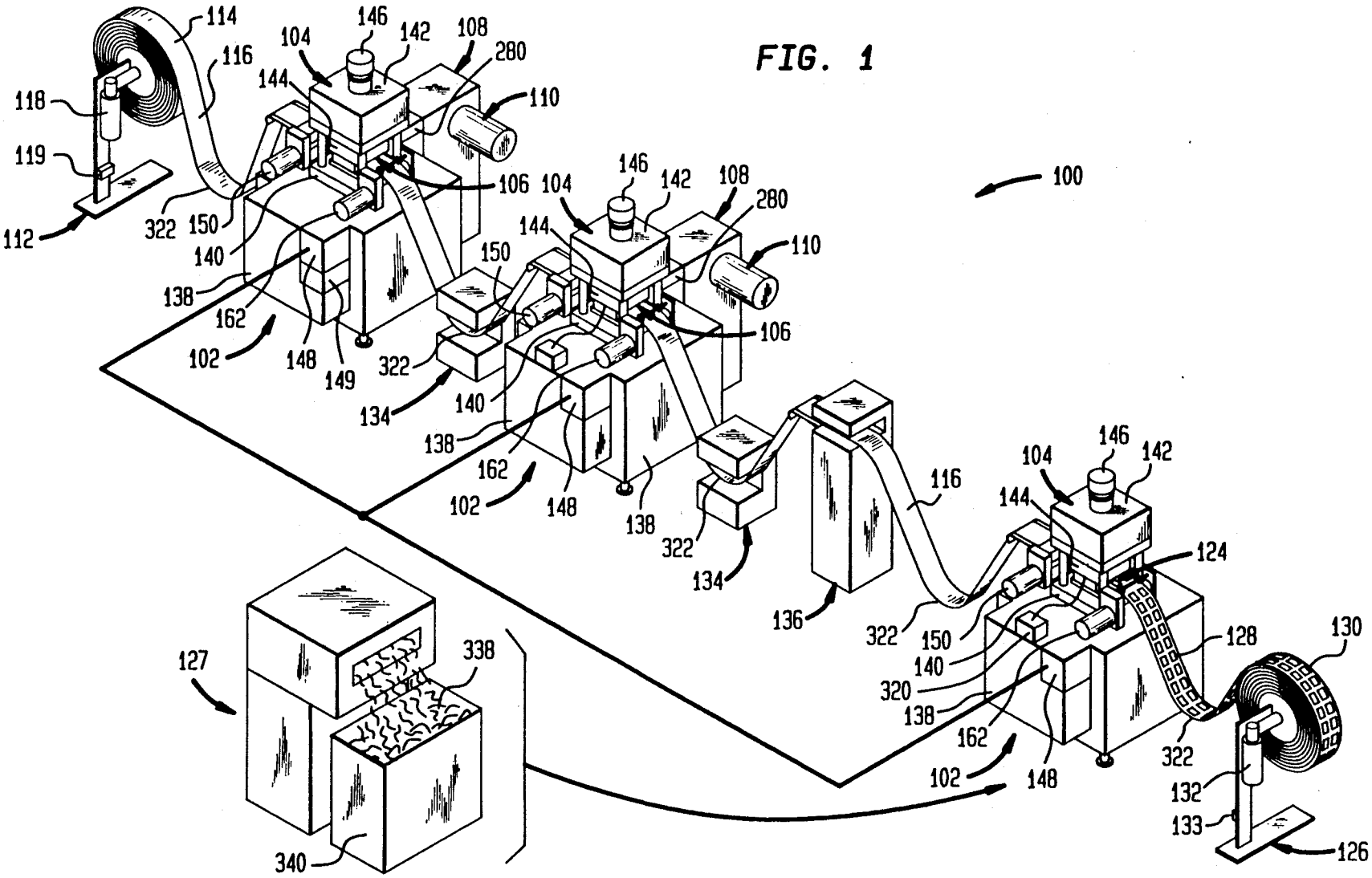
FIG. 1 is a perspective view of a diagrammatic illustration showing a continuous multi-station intaglio printing system constructed in accordance with the present invention having a plurality of engraving stations each including a hydraulic press provided with appropriate tooling for performing an engraving operation, a supply of a continuous web of paper or card stock, and optionally, one or more drying devices, slitting device, hydraulic die cutting device and scrap take-up roll or scrap shredder/chopper.

Referring now to the drawings, wherein like reference numerals represent like elements, there is shown in FIG. 1 a diagrammatic illustration of a continuous multi-station intaglio printing system generally designated by reference numeral 100. The intaglio printing system 100 is composed of any number of individual engraving stations 102 each including a hydraulic press 104, appropriate tooling 106 to perform the engraving operation, and a combination inking/wiper assembly 108 having a synchronized drive assembly 110. An unwinding stand 112 supports a continuous roll 114 of web material 116 such as letterhead paper or business card stock. The web material 116 is paid out by synchronized rotation of the roll 114 by means of a motor 118 via control of a photo-optic loop sensor 119 to the first engraving station 102, and then, through the intaglio printing system 100 for engraving.

The web material 116 travels through the intaglio printing system 100 to a die cutting station 120 including a hydraulic press 122 and appropriate tooling 124 for severing or die cutting the web material into individual sheets of letterhead paper or business cards of regular or irregular shape. A take-up stand 126 winds up any scrap web material 128 into a continuous roll 130 by operation of synchronized motor 132 via control of a photo-optic loop sensor 133. In the alternative, a scrap shredder/chopper device 127 may be used to shred and chop the scrap web material 128 into small pieces for disposal or recycling as to be described hereinafter. A web material drier 134 is optionally provided at each engraving station 102 to dry the printing ink on the web material 116 as may be required before the web material advances to the next process operation, such as engraving at the next engraving station 102 or being subjected to severing or die cutting at the die cutting station 120. A slitting device 136 may be positioned between the last of the engraving stations 102 and the die cutting station 120. The slitting device 136 functions to trim the edges of the web material 116 to provide sharp edges typically when engraving letterhead paper prior to being severed into individual sheets. The slitting device 136 may also be used for other functions, such as slitting the web material 116 into multiple longitudinal strips of equal or unequal width as may be desired based upon the product being engraved by the intaglio printing system 100.

The hydraulic press 104 at each engraving station 102 and the hydraulic press 122 at the die cutting station 120 are of similar construction and each include a base housing 138 supporting a stationary platen 140, a head 142 supporting a hydraulically operable ram 144 and a micrometer ram control 146. The ram control 146 provides precision adjustment of the ram stroke length. The hydraulic presses 104, 122, slitting device 136, unwinding stand 112 and take-up stand 126, as thus far described, are available from Preco Industries, Inc. of Lenexa, Kans. The hydraulic presses 104, 122 are known as the Preco Mini-Press, Model 1212.

The operation of each hydraulic press 104, 122 is controlled by a single board, master computer control unit 148 located at the first engraving station 102 which is connected to a slave computer control unit 149 at each of the engraving stations and die cutting station 120. The master computer control unit 148 enables the synchronized operation of the hydraulic presses 104, 122 during the engraving operation. The computer control unit 148 also enables the hydraulic presses 104, 122 to be set up with a variety of operating variables. For example, these operating variables include maximum hydraulic pressure, ram dwell hold time at the bottom of each ram stroke, dwell time between intermittent operation of the ram, feed distance and dwell time in the intermittent operation of web material feed roller units as to be described, and the like. These operating variables are keyboard entered by the operator using the computer control unit 148. It is to be understood that the specific operating variables described are part of the operating characteristics of the hydraulic presses 104, 122 as available from Preco Industries, Inc.

Figure 2:
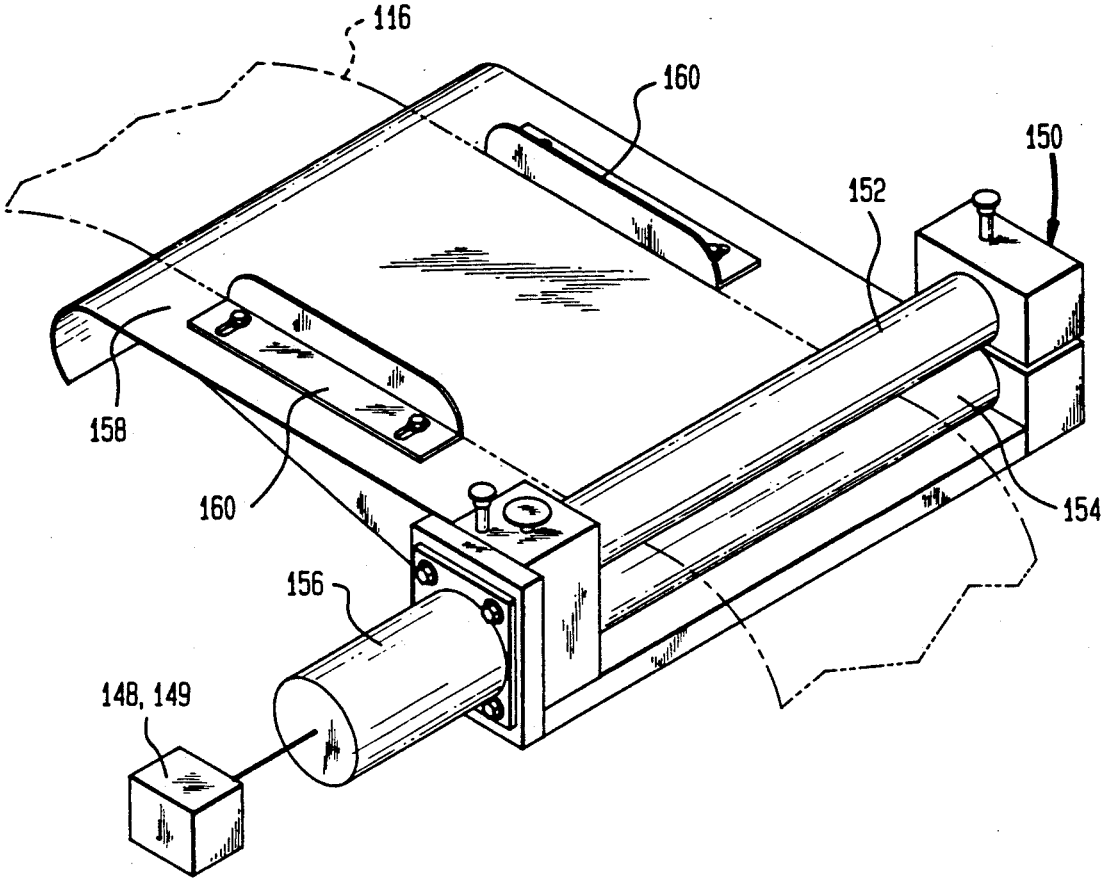
FIG. 2 is a perspective view of an intermittently operated feeding device for supplying a continuous web of paper or card stock to each hydraulic engraving press.

Referring now to FIG. 2, there is shown a feed roller unit 150 for intermittently advancing the web material 116 into hydraulic press 104, 122 in response to the computer control units 148, 149. The feed roller unit 150 includes a pair of spaced apart nip rollers 152, 154 through which the web material 116 is fed. One of the nip rollers 152, 154 is intermittently rotationally driven by motor 156 under programmed operation of the computer control units 148, 149. The incoming web material 116 is supported by a flat slide table 158 between a pair of adjustable, spaced apart edge guides 160.

Figure 3:
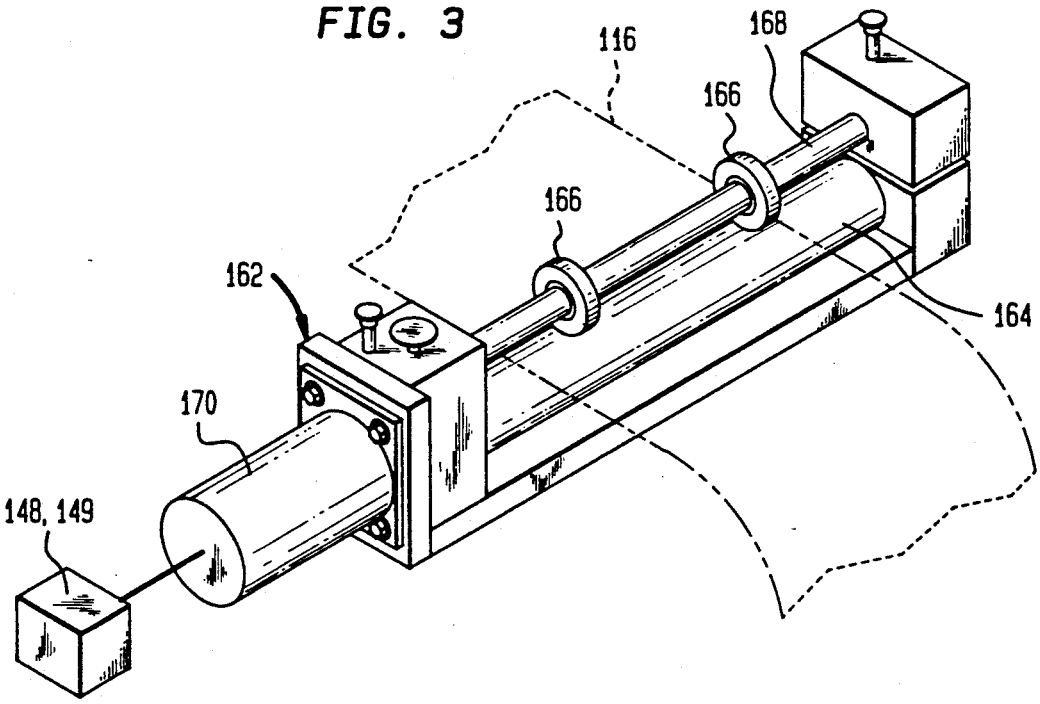
FIG. 3 is a perspective view of an intermittently operated feeding device for supplying a continuous web of paper or card stock from one hydraulic engraving press to an adjacent hydraulic engraving press.

Referring to FIG. 3, there is shown a similar feed roller unit 162 for intermittently advancing the web material 116 away from a hydraulic press 104, 122 by operation of the computer control units 148, 149. The feed roller unit 162 includes a lower nip roller 164 and a pair of adjustably spaced apart upper nip roller segments 166 journaled about shaft 168. The nip roller segments 166 may be positioned along the shaft 168 at spaced locations which do not interfere With those portions of the web material 116 which has just received engraved indicia which has yet to dry. The lower nip rollers 168 is intermittently rotationally driven by a motor 170 under operation of the computer control units 148, 149 to advance the web material 116 in the manner as described with respect to feed roller unit 150. The feed roller 150, 162 are a fully automated, microprocessor control feed system and easily programmed via computer control units 148, 149 for feed distance, speed of feed rollers, and dwell time. Feed roller units 150, 162 of the aforementioned type are available from Preco Industries, Inc., Model LFR having feed lengths of from 0.001 to 65.5 inches.

Figure 4:
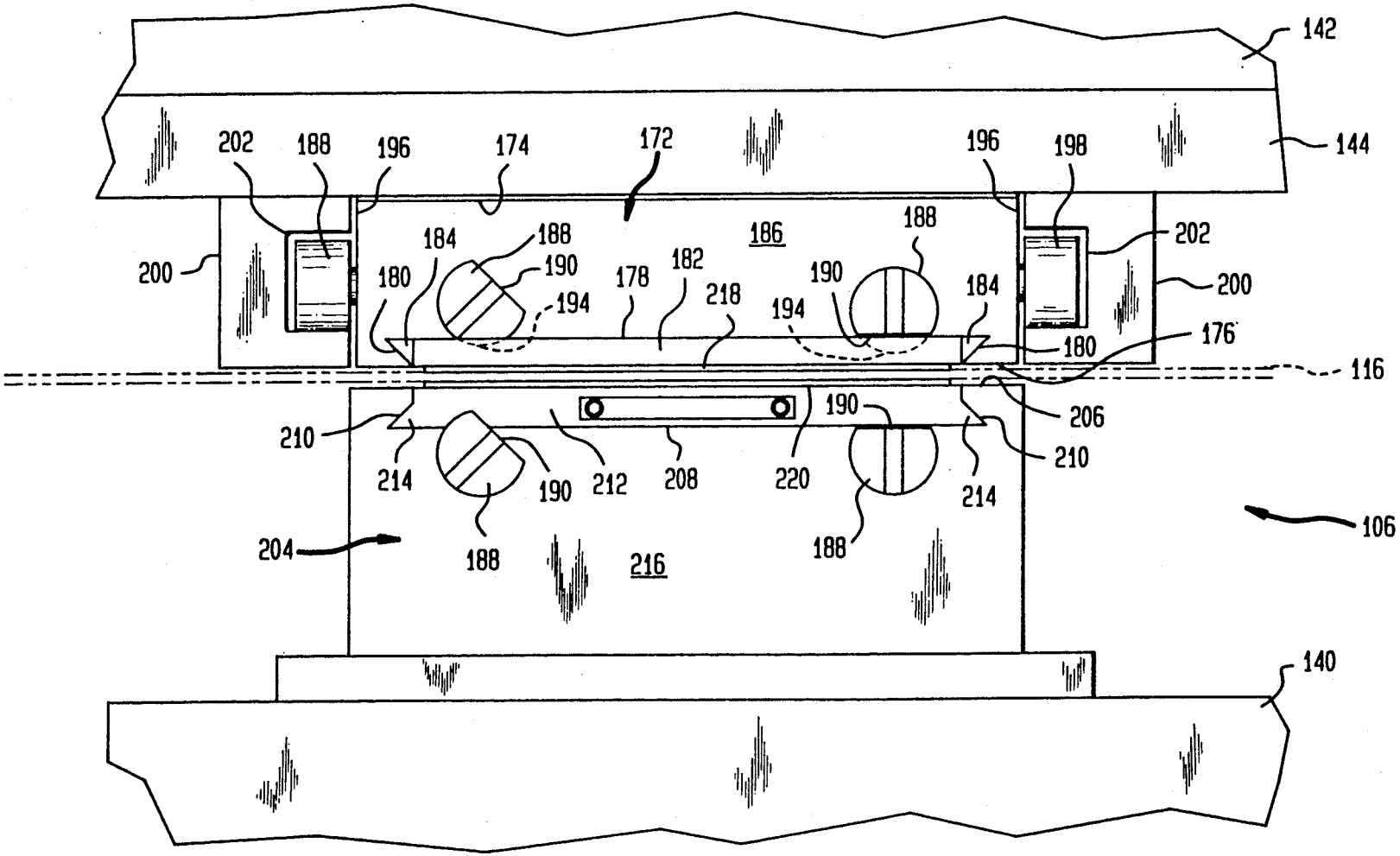
FIG. 4 is a front elevational view showing the engraving tooling arranged in operative association with a hydraulic press at one of the engraving stations.
Figure 5:
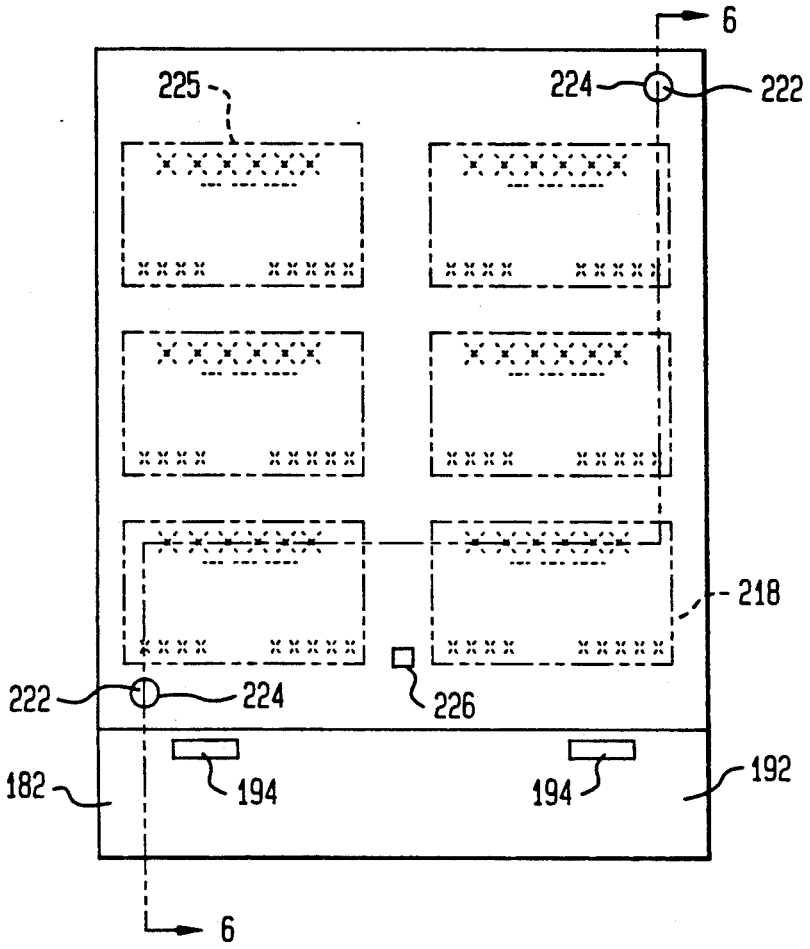
FIG. 5 is a top plan view showing, in combination, an engraving-die holder and an engraving-die forming part of the engraving tooling as shown in FIG. 4.
Figure 6:
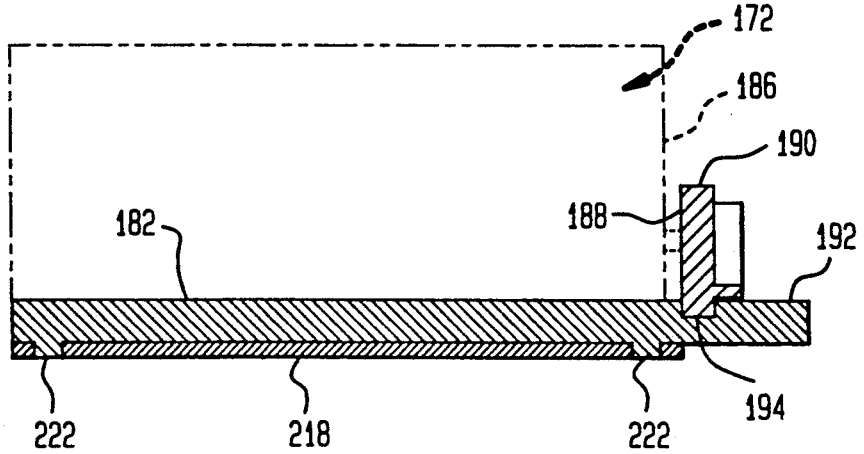
FIG. 6 is a cross-sectional view taken along lines 6—6 in FIG. 5, showing, in combination, the engraving-die holder and engraving-die.

Referring now to FIGS. 4, 5 and 6, there will now be described the engraving tooling 106 for each of the engraving stations 102. The tooling 106 includes a first support 172 constructed as a generally rectangular body having one face 174 arranged opposing ram 144 and another face 176 facing downward and provided with a large rectangular opening 178 having its lateral edges 180 formed with undercuts. A rectangular shaped flat engraving-die holder 182 having tapered lateral edges 184 is slidingly received within the opening 178 provided on the first support 172. The undercut lateral edges 180 of the opening 178 cooperate with the tapered lateral edges 184 of the engraving-die holder 182 to provide, in effect, a dove tail arrangement to ensure accurate registration of the engraving-die holder with the first support. The forward end face 186 of the first support 172 rotatably supports a pair of spaced apart circular knobs 188 each having a flat surface 190.

A forward portion 192 (see FIGS. 5 and 6) of the engraving-die holder 182 extends beyond the end face 186 of the first support 172 when received within opening 178 and is provided with a pair of spaced apart slots 194 arranged in alignment underlying knobs 188. The engraving-die holder 182 is maintained in fixed position within the opening 178 of the first support 172 by rotating the knobs 188 until a circular portion thereof is received within the aligned underlying slots 194. In order to remove the engraving-die holder 182 from the opening 178, the knobs 188 are rotated until their flat surfaces 190 are arranged overlying the slots 194 to provide clearance for removal of the engraving-die holder.

As thus far described, it is to be understood that the first support 172 is not attached to the ram 144, but rather, movably positioned underneath. In this regard, the lateral sides 196 of the first support 172 rotatably support journaled pairs of spaced apart rollers 198. A pair of spaced apart U-shaped guides 200 are secured to the ram 144 adjacent the lateral sides 196 of the first support 172. The guides 200 have a longitudinally-extending opening 202 which receive the rollers 198 of the first support 172. It will therefore be appreciated that the first support 172 is movable along the face of the ram 144 by the rollers 198 being supported within the opening 202 of the U-shaped guides 200.

The tooling 106 further includes a second support 204 formed as a generally rectangular body which is secured to the platen 140 underlying the ram 144 and in registration with the first support 172. The second support 204 has one face 206 facing the engraving-die holder 182 and provided with a large rectangular opening 208 having its lateral edges 210 formed with undercuts. A flat rectangular shaped counter-die holder 212 is provided with tapered lateral edges 214 which are received within the undercuts formed by the lateral edges 210 of the opening 208 in a dove tail arrangement as previously described with respect to the engraving-die holder 182. A pair of spaced apart knobs 188 having flat surfaces 190 are rotationally journaled to the end face 216 of the second support 204. Unlike the engraving-die holder 182, the counter-die holder 212 terminates flush with the end face 216 of the second support 204.

The counter-die holder 212 is secured within the opening 208 of the second support 204 by rotating the knobs 188 until a portion thereof is arranged overlying and in engagement with the exposed end face 216 of the counter-die holder. The counter-die holder 212, in turn, is removed from the opening 208 by rotating the knobs 188 until they are out of interference relationship with the end face 216 of the counter-die holder 212 via their flat surfaces 190. The position of the knobs 188 to allow removal of the engraving-die holder 182 and counter-die holder 212 are shown in the right hand portion of FIG. 4. On the other hand, the arrangement of the knobs 188 to secure the engraving-die holder 182 in opening 178 and the counter-die holder 212 in opening 208 are shown in the left-hand portion of FIG. 4.

The engraving-die holder 18 removably supports in precision alignment an engraving-die 218, while the counter-die holder 212 similarly supports a counter-die 220. Referring to FIGS. 5 and 6, the engraving-die 218 is constructed as a rectangular flat plate which is supported on the engraving-die holder 182. To enable extreme repetitive precision registration of the engraving die 218 with the engraving-die holder 182, the engraving-die holder is provided with a plurality of projecting registration pins 222. As shown, two registration pins 222 are arranged at diagonally opposed locations which are received within correspondingly aligned openings 224 provided within the engraving-die 218. The openings 224 are initially located with respect to the indicia 225 to be engraved during the typesetting process from which the engraving-die 218 is ultimately produced. This ensures precision registration of engraving die 218 with the engraving-die holder 182, while enabling easy and quick changing of the engraving-die itself. The engraving-die 218 may be provided with a registration mark 226 which enables accurate registration of the web material 116 with the tooling 106, 124 at each engraving station 102 and at the die cutting station 120 as to be described hereinafter. The counter-die 220 is similarly constructed as a rectangular flat plate removably secured overlying the surface of the counter-die holder 212 in the manner as thus far described with respect to the engraving die 218. In this regard, the counter-die holder 212 and counter-die 220 are constructed to include a plurality of registration pins 222 and aligned openings 224.

As a result of the thus far described construction of the engraving die 218 and counter-die 220, vis-a-vis registration pins 222 and openings 224, the engraving-die and counter-die are positionable opposing one another in accurate registration and enable the replacement with similar accurate registration in a simple and quickly performed replacement process. The accurate registration, as noted above, begins during the typesetting process for the indicia 225 to be engraved where the location of the openings 224 are designated, along with the registration mark 226. This ability to quickly and accurately change the engraving die 218 and counter-die, while maintaining their opposing precise registration, as well as their precise registration with the web material 116 has heretofore been unknown.

Figure 7:
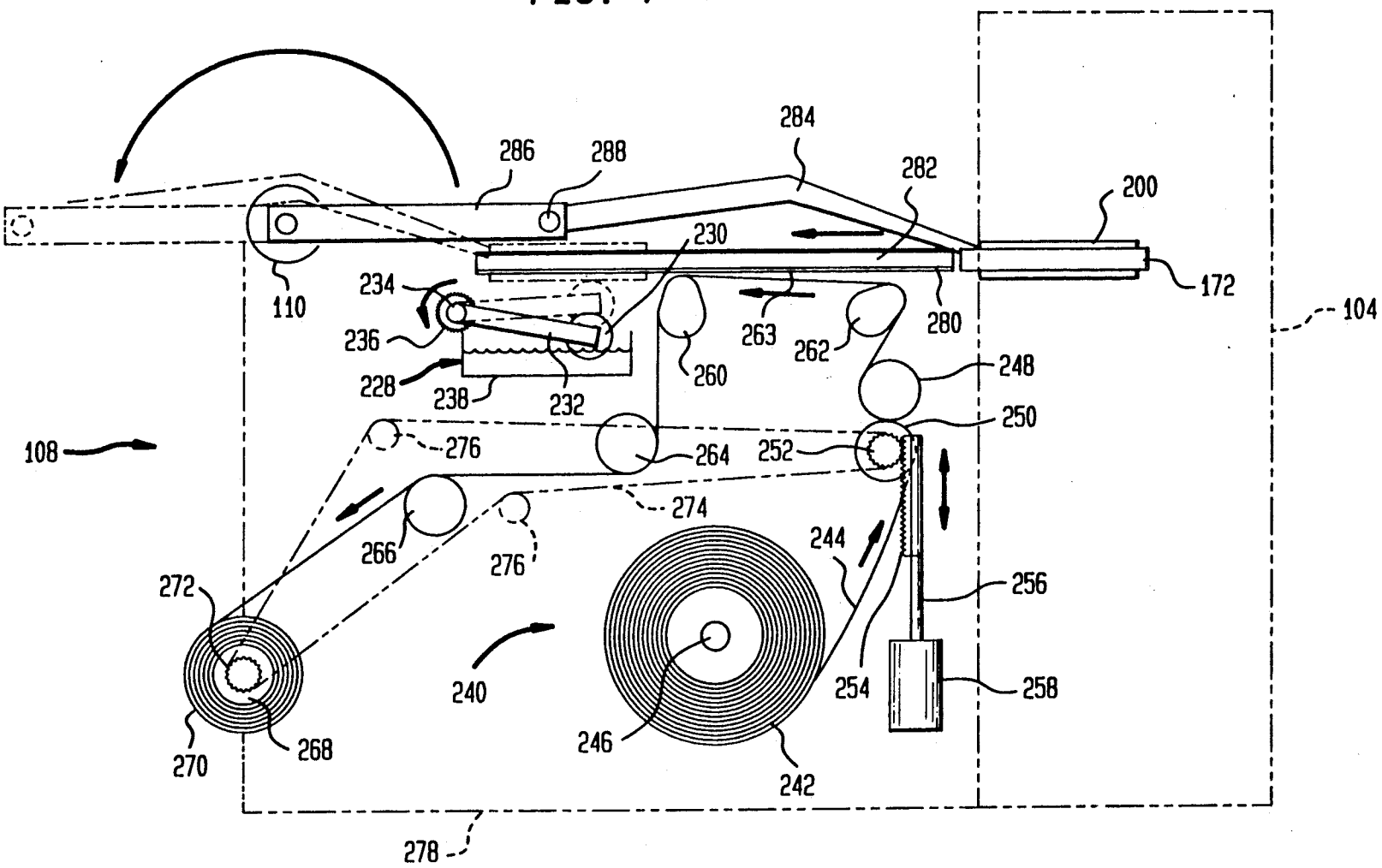
FIG. 7 is a diagrammatic illustration showing an assembly for intermittently inking and wiping the engraving-die during the engraving process at each engraving station.

In the engraving process, it is required that the engraving die 218 be subjected to an inking and wiping operation after each engraving stroke of the ram 144 by operation of the hydraulic press 104. In this regard, the engraving-die 218 is formed by photolithographic techniques with grooves in the form of ink wells corresponding to the indicia 225 to be engraved. These ink wells must be filled with ink between each engraving operation. At the same time, the face of the engraving-die 218 must be wiped clean of any residual ink, with the exception of the ink within the ink wells. The inking and wiping operation is performed by the inking/wiping assembly 108 as shown in FIG. 7.

Inking of the engraving-die 218 is achieved by an inking unit 228 which includes an inking roller 230 rotatably supported at its ends between a pair of spaced apart arms 232, only one of which is shown. The other end of each arm 232 is secured to a transverse shaft 234 which is rotatable by operation of an attached reversing gear 236 in a clockwise and counter-clockwise direction as indicated by the double-headed arrow. Upon rotation of the gear 236, the inking roller 230 is rotated about shaft 234 via arms 232 between two positions as shown in solid lines and in dashed lines. The inking roller 230 is initially maintained in its home position, as shown, at least partially submerged within an ink reservoir 238. The inking roller 230 is brought from its home position to its operative position as shown in dashed lines by rotation of gear 236. In the operative position the inking roller 230 engages the exposed surface of the engraving-die 218 to fill the ink wells as the engraving die is brought into operative association with the inking roller as to be described.

Wiping of residual ink from the face of the engraving-die 218 is achieved by a wiper unit 240 which includes a continuous roll 242 of wiper material 244 rotationally supported about a transverse stationary shaft 246. The wiper material 244 is paid out in the direction of the single-headed arrow by means of a pair of nip rollers 248, 250 arranged on opposite sides of the wiper material. A gear 252 having a one way clutch for single direction rotation is secured to nip roller 250 for advancing the wiper material 244 a predetermined incremental amount during operation of the wiper unit 240. This is accomplished by a linear gear rack 254 being in meshed engagement with gear 252 and which is linearly advanced by its attachment to a piston rod 256 extending from a pneumatic cylinder 258.

The wiper material 244 after exiting the nip formed between the nip rollers 248, 250 is received over a pair of spaced apart cam rollers 260, 262. The wiper material 244 stretched between the cam rollers 260, 262 forms a wiper pad 263 which functions during operation of the wiper unit 240 to wipe residual ink from the face of the engraving-die 218. The wiper material 244 passes over a pair of spaced apart, transversely arranged guide rods 264, 266 to a take up spool 268 to form a continuous roll 270 of used wiper material. The take up spool 268 is rotationally driven by a torque limiting or slip sprocket gear 272. Gear 272 is simultaneously driven along with gear 252 attached to nip roller 250 by means of common drive chain 274 which also engages planetary gears 276. It is to be understood that the aforementioned thus far described components of the inking unit 228 and wiper unit 240 are transversely mounted between a pair of spaced apart side frames 278, only one of which is shown, which are arranged adjacent each hydraulic press 104 within an engraving station 102.

A pair of spaced apart U-shaped guides 280, only one of which is shown, each having a longitudinally-extending opening 282 are respectively secured to the side frames 278 in collinear alignment with the guides 200 which are attached to the ram 144. When the ram 144 is in its upper most rest position, the guides 200, 282 form a continuous linear track to enable movement of the first support 172 to which the engraving die 218 is attached to be translated from its position underlying the ram 144 into operative association with the inking unit 228 and wiping unit 240, and then subsequently back to its initial rest position underlying the ram. Translational movement of the first support 172 along guides 200, 280 is achieved by a pair of pivotably connected arms 284, 286 at pivot point 288. The free end of arm 284 is secured to the first support 172, while the free end of arm 286 is secured to the drive assembly 110 which includes a motor, not shown.

The operation of the inking unit 228 and wiper unit 240 are controlled by timing chains (not shown) coupled to the drive assembly 110 as the first support 172 is being translated along guides 280 into operative association with the inking unit and wiper unit. Operation of the drive assembly 110 is effective to cause rotation of arms 284, 286 in a counter-clockwise direction as indicated by the single headed arrow from their initial home position as shown in solid lines to their position shown in dashed lines as they fold upon themselves during rotation through a first 180°, and then back to their original position as shown in solid lines during continued rotation through a second 180° upon unfolding of the arms. During the first 180° of rotation of arms 284, 286, the first support 172 and hence engraving-die 218 is translated along guides 200, 280 from within the hydraulic press 104 into operative association with the inking unit 228 and wiping unit 240. During the second 180° of rotation of arms 284, 286, the first support 172 is advanced along guides 200, 280, back to its location underlying the ram 144 within the hydraulic press 104.

More specifically, as arms 284, 286 are rotated through the first 180°, the first support 172 and the engraving-die 218 are moved along guides 282 past the inking unit 238 and the wiper unit 240 to the position shown in dashed lines. The arms 284, 286 continue their rotation through a second 180°, as the inking unit 228 and the wiper unit 24 become operative to ink and wipe the engraving-die 218. As the first support 172 begins its return movement along guides 282 gear 236 of the inking unit 228 is rotated to cause the inking roller 230 to be raised into engagement with the face of the engraving-die 218, and after passage of the engraving-die, is subsequently returned to its position within the ink reservoir 238. When the first support 172 is advanced past the inking roller 230, the cam rollers 260, 262 are rotated to cause the wiper pad 263 to tilt upwardly and downwardly in a wave motion to compressively engage the face of the engraving-die 218. The engraving-die moves therepast and returns to its location underlying the ram 144. The wiper pad 263 absorbs the residual ink from the face of the engraving-die 218.

In order to prepare the wiper unit 240 for the next wiping operation, the wiper paper 244 is paid out from roll 242 a predetermined amount to provide fresh wiper paper between the cam rolls 260, 262, while at the same time, the used wiper paper is being wound up by take up spool 268 in the form of continuous roll 270. The wiper paper 244 is paid out a predetermined amount by operation of the nip rollers 248, 250, in conjunction with the actuation of pneumatic cylinder 258 and the meshed engagement of linear gear rack 254 with gear 252. The precise amount of wiper paper 244 being paid out is controlled to correspond to the length of paper required to span the space between the cam rollers 260, 262. This is achieved by the diameter and number of teeth on gear 252, as well as the stroke length of the linear gear rack 254.

As the wiper material 244 is being paid out by operation of nip rollers 248, 250, the wiper paper is maintained in a taught condition by concurrently rotating the take up spool 268 by drive chain 274. Gear 272 is sized to be somewhat larger in diameter than gear 252 to provide a slightly greater degree of rotation to maintain the wiper paper 244 taught as it is being wound up on the take up spool 268. This overdriving of the take up spool 268 does not pay out the wiper paper 244 from the roll 242 as the gear 272 is constructed as a torque limiter or slip sprocket which allows for a slight overdrive to maintain the wiper paper taught.

The pay out of the wiper paper 244 a predetermined amount by operation of the nip rollers 248, 250 is a distinct advantage over the previously known technique of solely driving the take up spool 268. In this regard, as the diameter of roll 270 of the used wiper material increases, each incremental rotation of the take up spool 268 will result in an increasing pay out of the wiper material 244. As the amount of pay out of the wiper material 244 need only be sufficient to provide unused wiper material spanning the space between cam rollers 260, 262, increasing the pay out results in increasing waste of the wiper paper. Thus, the wiper unit 240 by providing a predetermined pay out during each operation, irrespective of the diameter of the roll 270 of used wiper material, is a substantial enhancement over the prior known take up technique.

Figure 8:
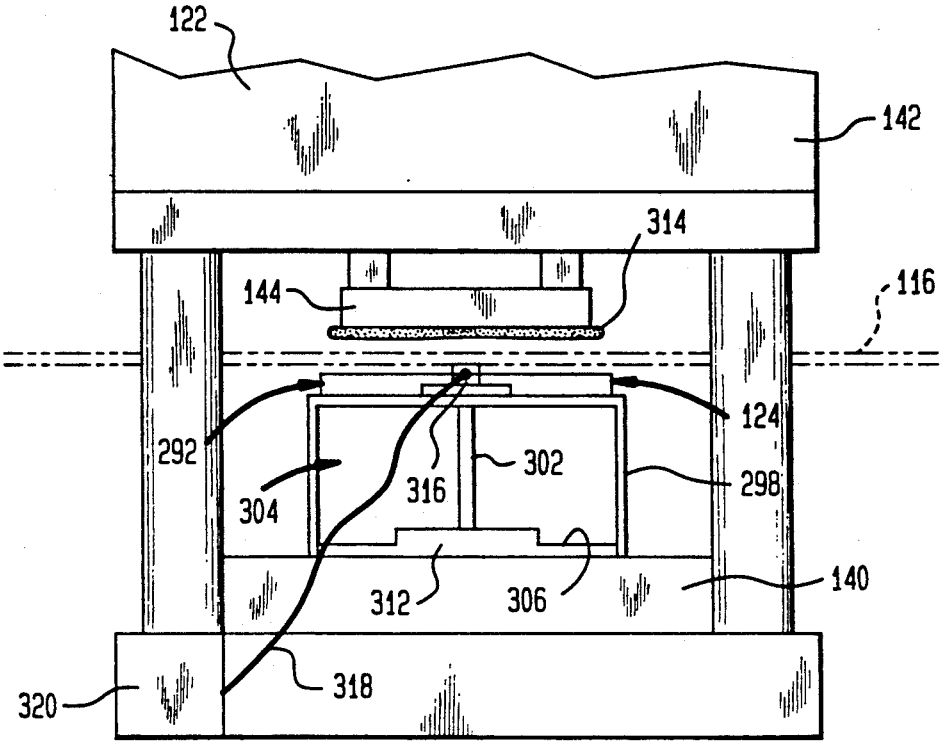
FIG. 8 is a front elevational view of the tooling for the hydraulic die cutting device and showing an underlying compartmentalized container for segregated storage of individual die cut pieces from the web of paper or card stock.
Figure 9:
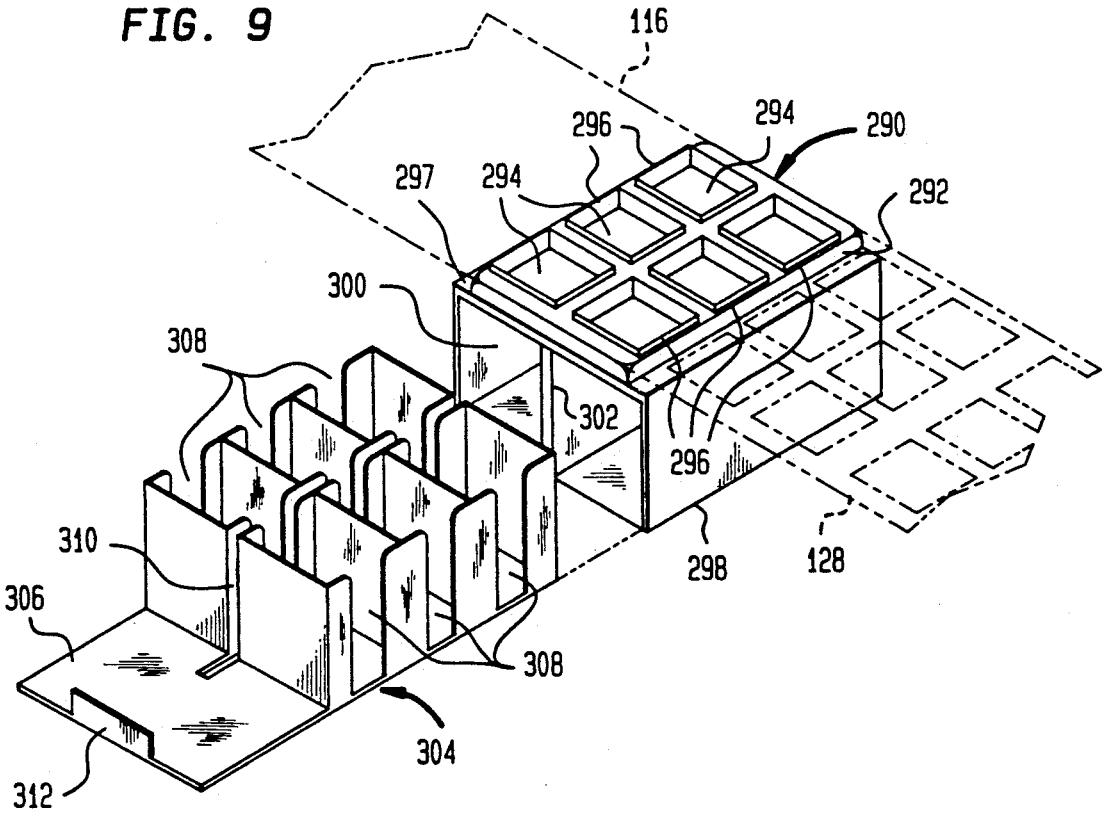
FIG. 9 is a perspective view showing the die cutter tooling and compartmentalized container as shown in FIG. 8.

Referring now to FIGS. 8 and 9, there will be described the construction and operation of the tooling 124 at the die cutting station 120. The tooling 124 is operative in severing the engraved web materials 116 into individual sheets of letterhead paper or die cutting into a plurality of business cards and the like of regular or irregular shape. The specific tooling in 124 shown is designed for die cutting the engraved web material 116 into an array of six business cards of rectangular shape upon each stroke of ram 144 under operation of the hydraulic press 122. In the embodiment illustrated, a cutting die 290 is constructed from a generally rectangular plate 292 having a plurality of openings 294 arranged in a matrix of rows and columns. Each opening 294 is sized and shaped to conform to the business card or other item to be die cut from the engraved web material 116. Surrounding each opening 294 and extending upwardly from the plate 294 are rectangular shaped die cutting knives 296. Once again, the particular size and shape of the die cutting knives 296 conform to the size and shape of the business cards or other items to be die cut from the engraved web material 116.

The cutting die 290 is secured to the top wall 297 of a rectangular shaped storage container 298 which itself is secured to the stationary platen 140. The openings 294 within the cutting die 290 communicate with the hollow interior 300 of the storage container 298 through similar openings within the top wall 297. An internal dividing wall 302 separates the interior 300 into two compartments, as well as providing sufficient mechanical strength to the storage container 298 in absorbing the forces of the ram 144 during the die cutting operation.

Removably received within the storage container 298 is a multi-compartment cardholder 304. The cardholder 304 is constructed from a rectangular base plate 306 which supports a plurality of upwardly extending walled compartments 308 arranged in a matrix of rows and columns. The cardholder 304 is received within the storage container 298 with the compartments 308 underlying in registration with openings 294 within the cutting die 290. A slot 310 is provided within the cardholder 304 between the rows of individual compartments 308 to receive, and thereby avoiding interference, with the dividing wall 302. The cardholder 304 may be inserted and removed from the storage container 298 by means of a forwardly extending handle 312. The cutting die 290 is positioned underlying ram 144 opposing a generally rectangular flat cutting die counter 314 constructed from hard synthetic material so as to the absorb the force of the ram and to prevent dulling of the die cutting knives 296.

Although the cutting die 290 has been shown and described as being of generally rectangular shape, it is to be understood that other shapes, regular or irregular, may be provided by suitable design of the die cutting knives 296. The cutting die 290 may be replaced by a single transversely arranged die cutting knife for severing the engraved web material 116 into single sheets of letterhead paper in a similar die cutting operation during each stroke of the ram 144. In this regard, the underlying storage container 298 and cardholder 304 would be constructed with a single compartment for receiving the individually severed sheets of letterhead paper. In addition, other devices for severing the engraved web material 116 into individual sheets may include a self-contained sheeting knife device which is designed for cutting various materials into predetermined lengths with a high degree of precision. One such sheeting knife device is available from Preco Industries, Inc. Additionally, the engraved web material 116 may be severed into individual sheets using a rotary cutter as to be described hereinafter.

Adjacent the edge of the cutting die 290, as shown in FIG. 8, there is positioned a photo-optic sensor 316 connected via fiber-optic cable 318 to a photo-optic controller 320. The photo-optic controller 320, when employed, is operative for controlling motors 156, 170 of the feed roller units 150, 162 located at the die cutting station 120. The photo-optic sensor 316 and photo-optic controller 320 are available from Preco Industries, Inc.

In operation, a registration mark 226, see FIG. 5, is engraved on the web material 116 at the first engraving station 102. At the die cutting station 120, motors 156, 170 of the feed roller units 150, 162 advance the engraved web material 116 into approximate registration with the cutting die 290. As the engraved web material 116 is advanced within the area of the cutting die 290, the photo-optic controller 320 takes over control of the feed roller units 150, 162 to slow down the web material feed speed to enable the photo-optic sensor 316 to read the registration mark 226. Once the registration mark 226 aligns itself with photo-optic sensor 316, a signal is sent to the photo-optic controller 320 to stop the feed roller units 150, 162 thereby positioning the engraved web material 116, and specifically the indicia 225 thereon, in precise registration with the cutting die 290. One registration process using registration marks and photo cells in a multi-station screen printing system is known from U.S. Pat. No. 3,848,528.

The photo-optic sensor 316 and photo-optic controller 320 may also be employed at the engraving stations 102. In this regard, the first engraving station 102 would engrave the web material 116 with the registration mark 226. At each subsequent engraving station 102, the photo-optic sensor 316 would detect the presence of the registration mark 226 so as to align the engraved web material 116 with the engraving-die 218. This registration process with the engraving die 118 is particularly useful in providing precise registration when performing multi-color engraving of the web material 116.

Figure 10:
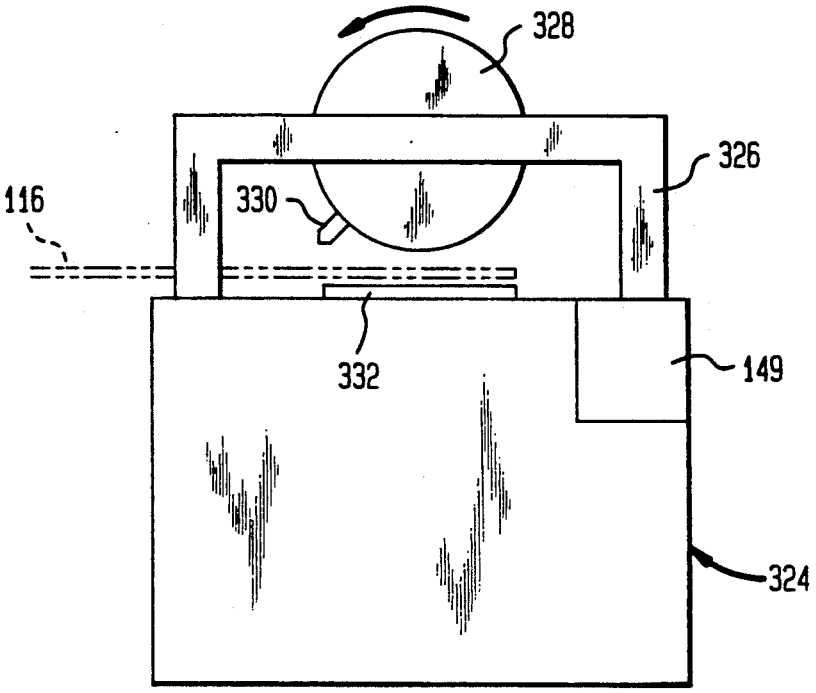

Referring now to FIG. 10, there is shown a rotary cutter 324 for severing the engraved web material 116 into individual sheets of letterhead paper. The rotary cutter 324 includes a frame 326 rotatably supporting a cylindrical cutting drum 328 having a radially projecting knife 330 extending transversely thereacross. Underlying the cutting drum 328 there is positioned a support block 332 made of synthetic material over which the engraved web material 116 to be severed is supported.

In operation, the cutting drum 328 is rotated one revolution to cause the knife 330 to sever a predetermined length of the engraved web material 116 into a single sheet upon its engagement with support block 332. The length of the severed sheet of engraved web material 116 will be determined by the circumference of the cutting drum 328. For example, in the case of letterhead paper, the circumference of the cutting drum 328 would be 11 inches. Although only one knife 330 has been shown, it is to be understood that multiple knives may be employed, with the circumferential distance between the knives designating the length of the severed sheet. The operation of the rotary cutter 324 is controlled by means of the computer control units 148, 149. The individual sheets cut from the engraved web material 116 may be collected in a manner similar to that disclosed with respect to the storage container 298 as shown in FIGS. 8 and 9.

Referring once again to FIG. 1, there will now be briefly described the multi-color engraving of business cards in accordance with the intaglio printing system 100 of the present invention. Web material 116 in the nature of business card stock is paid out from roll 114 by means of unwinding stand 112 via operation of motor 118. The web material 116 is paid out to provide a loop 322 which is controlled by photo-optic loop sensor 119. The loop 322 provides for an accumulation of web material 116 to enable smooth intermittent feeding of the web material through the intaglio printing system 100. The web material 11 is fed to the first engraving station 102 by the synchronized operation of feed roller units 150, 162 via computer control units 148, 149.

Prior to the engraving operation, the engraving-die 218 via first support 172 is removed from underlying ram 144 and brought into operative association with the inking unit 228 and wiper unit 240 as previously described with respect to FIG. 7. Once the engraving-die 218 has returned to its home position underlying ram 144, the ram via computer control units 148, 149 is operated hydraulically by the hydraulic press 104 to engrave a portion of the indicia 225 of a first color, along with the registration mark 226 on the underlying web material 116. That portion of the web material 116 having just been engraved at the first engraving station 102 is advanced by the feed roller units 150, 162 toward the next engraving station while the engraving-die 218 is once again subjected to inking and wiping via inking unit 228 and wiping unit 240. As such, at each intermittent operation of ram 144, the web material 116 is engraved with a first color of a portion of the indicia 225 corresponding to the engraving die 218.

As the engraved web material 116 is advanced from the first engraving station 102, the web material is formed into a loop 322 and is received in operative relationship with web material dryer 134. The web material dryer 134 functions to dry the printing ink on the engraved web material 116 prior to the next engraving station 102. The web material dryer 134 may be constructed as a circulating hot air dryer, one equipped with heating lamps, or the like. In addition, depending upon the engraving conditions and the surrounding environment, i.e., temperature and relative humidity, the engraved web material 116 may dry naturally between engraving stations 102 thereby eliminating any requirement for a web material dryer 134.

At the second engraving station 102, the previously engraved web material 116 is engraved with a second color with another portion of the indicia 225 represented by the engraving-die 218 at the second engraving station. The engraving operation at the second engraving station 102 is similar to that performed at the first engraving station. However, the second engraving station 102 is optionally provided with a photo-optic sensor 316 and a photo-optic controller 320. The photo-optic sensor 316 detects the presence of the registration mark 225 thereby registering the previously engraved indicia 225 with the engraving-die 218 at the second engraving station 102. This registration can also be achieved in the absence of a photo-optic sensor 316 by use of the precision operation of the feed roller units 150, 162 under control of the computer control units 148, 149.

Upon exiting the second engraving station 102, the engraved web material 116 may continue, in sequence, to a plurality of similar engraving stations 102. Thus, the present invention is not limited in scope to an intaglio printing system 100 having only two engraving stations 102. The engraved web material 116 is advanced through a loop 322 and, optionally, in association with a web material dryer 134 as previously described. In addition, the engraved web material 116, if desired, can be subjected to a slitting operation via slitting device 136. The slitting device 136 has particular utility in engraving letterhead paper where the original web material 116 has poor quality edges. As with the web material dryers 134, the slitting device 136 is an optional component of the intaglio printing system 100.

The web material 116 prior to entering the die cutting station 120 is formed into a loop 322 as previously described. The indicia 225 on the engraved web material 116 is registered with the cutting die 290 using the registration mark 226 in conjunction with the photo-optic sensor 316 and photo-optic controller 320. Although the photo optic sensor 316 has been provided at the die cutting station 120, it is to be understood that registration of the engraved web material 116 with the cutting die 290 may also be achieved by operation of the feed roller units 150, 162 under control of the computer control units 148, 149. Individual business cards are die cut from the engraved web material 116 in a matrix of rows and columns and are received within the individual compartments 308 of the card holder 304. When the card holder 304 has been filled, it is removed from the storage container 298 upon engaging handle 312. The business cards, in individual stacks, may be easily packaged and sent to a single customer, or to multiple customers if each of the business cards have been engraved with different indicia 225.

Figure 11:
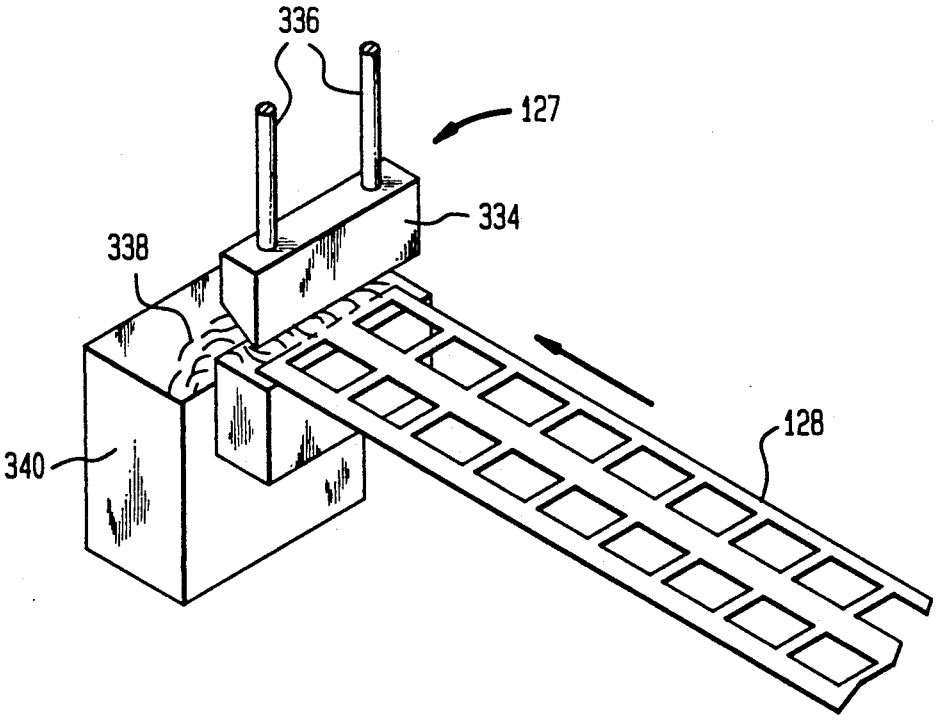
FIG. 11 is a diagrammatic illustration showing the operation of a scrap shredder/chopper for the scrap web material.

The scrap web material 128 is advanced through a loop 322 to the take up stand 126 where it is rolled into a roll 130 by operation of motor 132 which controls the presence of the loop via photo optic sensor 133. The scrap web material 128 may also be fed to a scrap shredder/chopper device (127) as opposed to the take up stand 126. In this regard, the scrap shredder/chopper device 127 automatically cuts and chops the scrap web material 128 into predetermined lengths which may be suitable for recycling, substantially reducing the amount of space required for the scrap, as well as reducing production down time needed to replace roll 130. Referring to FIG. 11, the scrap shredder/chopper device 127 is generally provided with a reciprocating blade 334 via support cylinders 336 for cutting and chopping the scrap web material 128 into predetermined lengths 338. The predetermined lengths 338 are received in a suitable storage container 340 which may be a reusable container or a disposable plastic bag and the like. One such scrap shredder/chopper device suitable for use in the intaglio printing system 100 is available from E.B.A. Machine Works, West Germany.

Figure 12:
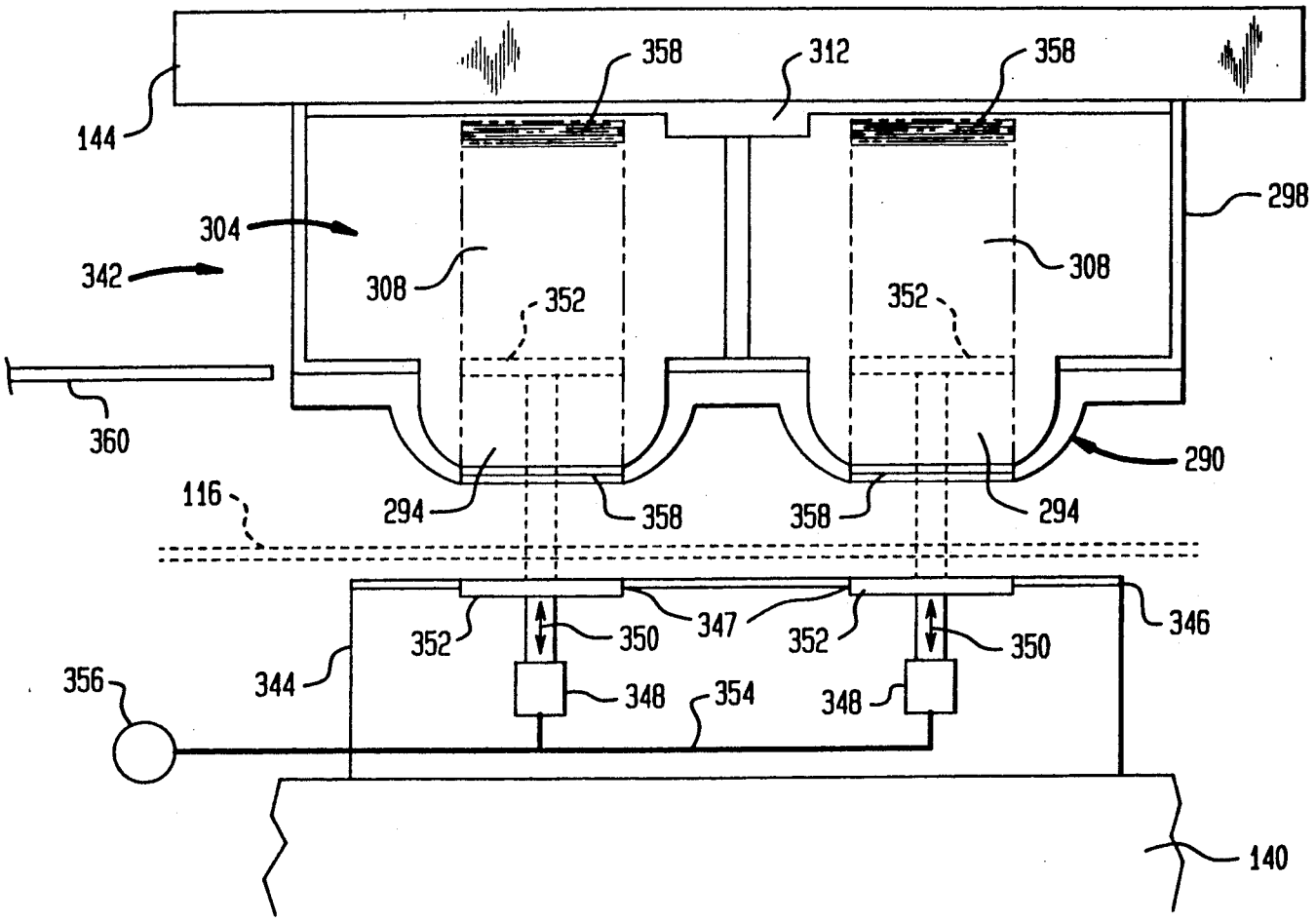
FIG. 12 is a front elevational view of the tooling for the hydraulic die cutting device in accordance with another embodiment of the present invention.

As described with respect to FIGS. 8 and 9, individual business cards which have been cut by the cutting die 290 fall into the individual compartments 308 of the cardholder 304. As the business cards must free-fall, it has been found there is a tendency of such cards to twist and become hung-up during their fall within the individual compartments 308. In improving upon this described arrangement, there is shown in FIG. 12 tooling 342 at the die cutting station 120 in accordance with another embodiment of the present invention. As shown, the storage container 298 supporting the cutting die 290 is mounted in an inverted position to the ram 144 opposing the stationary platen 140. As previously described, the storage container 298 receives the cardholder 304 with the individual compartments 308 overlying in registration with openings 294 within the cutting die 290. Underlying the cutting die 290 and mounted to the platen 140 is a base block 344 supporting a modified cutting die counter 346. The cutting die counter 346 is provided with a matrix of openings 347 arranged in rows and columns in alignment with the matrix of openings 294 in the cutting die 290. The openings 347 within the cutting die counter 346 are smaller in size than the openings 294 within the cutting die 290.

Mounted within the base block 344 are a plurality of pneumatic cylinders 348 arranged in a matrix of rows and columns each underlying an opening 347 within the cutting die counter 346. Each pneumatic cylinder 348 is provided with a piston rod 350 which supports a flat plunger 352 received within each of the openings 347 within the cutting die counter 346. The pneumatic cylinders 348 are commonly connected via control line 354 to a common control switch 356 for simultaneous operation thereof.

In operation of the tooling 342, individual business cards 358 are cut from the engraved web material 116 by the cutting die 290 during each stroke of the ram 144. The individual cut business cards 358 are initially held within the mouth of the openings 294 of the cutting die 290 by virtue of their interference fit therein. During each successive operation of the ram 144, the previously cut business cards 358 are pushed upwardly into the storage container 298 until the compartments 308 are filled to a predetermined amount less than their full capacity. The business cards 358 within the compartments 308 are held from falling out through openings 294 of the cutting die 290 by virtue of the last business card being in interference fit within the opening as previously described.

Upon completion of the die cutting operation, i.e., when the compartments 308 have been filled, the operator activates switch 356 to simultaneously operate pneumatic cylinders 348 so as to advance each plunger 352 upwardly through openings 294 within the cutting die 290 to a position substantially flush with the mouth of each of the compartments 308 as shown by the dashed lines. Upon advancing each plunger 352, the cut business cards 358 within the column formed by the thickness of the cutting die 290 and the opening 294, are pushed upwardly into the compartments 308 of the cardholder 304. At this time, the cardholder 304 may be withdrawn from within the storage container 298 across the face of an adjacently positioned flat plate 360 which prevents the cut business cards 358 from falling out of the compartments 308.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A continuous intaglio printing apparatus comprising a hydraulic press having an intermittently moveable ram, supply means for supplying a continuous web of material to said hydraulic press, intaglio printing means in operative association with said ram for engraving said web of material upon intermittent movement of said ram by operation of said hydraulic press, said intaglio printing means including first support means for removably supporting an engraving-die underlying said ram, application means for applying printing fluid to said engraving-die, wiping means for wiping excess printing fluid from said engraving-die, moving means coupled to said first support means for moving said engraving-die from a first position underlying said ram to a second position in operative association with said application means and said wiping means, and then to said first position between intermittent movement of said ram, a first pair of guides attached to said ram on either side of said first support means, said first pair of guides concurrently moveable with said movement of said ram, and a second pair of guides unattached to said first pair of guides fixedly positioned adjacent said application means and said wiping means in alignment with said first pair of guides, said second pair of guides remaining stationary during movement of said ram and said first pair of guides, the sides of said first support means engaging said first and second pair of guides for translational movement therealong in response to the operation of said moving means when said first pair of guides are in registration with said second pair of guides between intermittent movement of said ram.

2. The intaglio printing apparatus of claim 1, wherein said intaglio printing means further includes second support means for removably supporting a die-counter in opposed spaced relationship to said engraving-die.

3. The intaglio printing apparatus of claim 1, wherein said first support means includes an engraving-die-holding having a plurality of registration elements extending therefrom, said engraving-die including a plurality of openings for receiving said registration elements, whereby said engraving-die is aligned with said engraving-die holder.

4. The intaglio printing apparatus of claim 2, wherein said second support means includes a die-counter holder having a plurality of registration elements extending therefrom, said die-counter including a plurality of openings for receiving said registration elements, whereby said die-counter is aligned with said die-counter holder.

5. The intaglio printing apparatus of claim 1, wherein said wiping means comprises means for supplying a continuous web of wiper material for wiping excess printing fluid from said engraving-die, a pair of nip rollers engageable on opposite sides of said web of wiper material for advancement thereof upon rotation of at least one of said rollers, and rotation means for rotating said at least one of said rollers.

6. The intaglio printing apparatus of claim 5, wherein said rotation means includes a gear coupled to said at least one of said rollers, a gear rack engaged with said gear, and adancing means for advancing said gear rack while engaged with said gear for rotating of said at least one of said rollers.

7. The intaglio printing apparatus of claim 6, further including a take-up roll for said web of wiper material, said take-up roll coupled to said at least one of said rollers for concurrent rotation therewith.

8. The intaglio printing apparatus of claim 7, further including drive means for driving said take-up roller to maintain said web of wiper material taught.

9. A continuous multi-station intaglio printing system comprising a hydraulic press having an intermittently movable ram at each of a plurality of engraving stations, supply means for supplying a continuous web of material successively to said hydraulic press at each of said plurality of engraving stations, intaglio printing means at each of said plurality of engraving stations in operative association with said ram for engraving said web of material at each said engraving station upon intermittent movement of said ram by operation of said hydraulic press, said intaglio printing means including first support means for removably supporting an engraving-die underlying said ram, application means for applying printing fluid to said engraving-die, wiping means for wiping excess printing fluid from said engraving-die, moving means coupled to said first support means for moving said engraving-die from a first position underlying said ram to a second position in operative association with said application means and said wiping means, and then to said first position between intermittent movement of said ram, a first pair of guides attached to said ram on either side of said first support means, said first pair of guides concurrently moveable with said movement of said ram, and a second pair of guides unattached to said first pair of guides fixedly positioned adjacent said application means and said wiping means in alignment with said first pair of guides, said second pair of guides remaining stationary during movement of said ram and said first pair of guides, the sides of said first support means engaging said first and second pair of guides for translational movement therealong in response to the operation of said moving means when said first pair of guides are in registration with said second pair of guides between intermittent movement of said ram.

10. The intaglio printing system of claim 9, wherein said intaglio printing means further includes second supporting means for removably supporting a die-counter in opposed spaced relationship to said engraving-die.

11. The intaglio printing system of claim 9, wherein said first support means includes an engraving-die holder having a plurality of registration elements extending therefrom, said engraving-die including a plurality of openings for receiving said registration elements, whereby said engraving-die is aligned with said engraving-die holder.

12. The intaglio printing system of claim 10, wherein said second support means includes a die-counter holder having a plurality of registration elements extending therefrom, said die-counter including a plurality of openings for receiving said registration elements, whereby said die-counter is aligned with said die-counter holder.

13. The intaglio printing system of claim 9, wherein said wiping means comprises means for supplying a continuous web of wiper material for wiping excess printing fluid from said engraving-die, a pair of nip rollers engageable on opposite sides of said web of wiper material for advancement thereof upon rotation of at least one of said rollers, and rotation means for rotating said at least one of said rollers.

14. The intaglio printing system of claim 13, wherein said rotation means includes a gear coupled to said at least one of said rollers, a gear rack engaged with said gear, and advancing means for advancing said gear rack while engaged with said gear for rotation of said at least one of said rollers.

15. The intaglio printing system of claim 14, further including a take-up roll for said web of wiper material, said take-up roll coupled to said at least one of said rollers for concurrent rotation therewith.

16. The intaglio printing system of claim 15, further including drive means for driving said take-up roller to maintain said web of wiper material taught.

17. The intaglio printing system of claim 9, further including advancing means for intermittently advancing said continuous web of material to and from said plurality of engraving stations.

18. The intaglio printing system of claim 9, further including positioning means in association with at least one of said plurality of engraving stations for registering said web of material with said intaglio printing means.

19. The intaglio printing system of claim 9, further including severing means for severing said web of material into individual pieces of engraved material.

20. The intaglio printing system of claim 19, further including scrape take-up means adjacent said severing means for taking-up any residual portions of said web of material not forming said individual pieces of said engraved material.

21. The intaglio printing system of claim 19, further including a storage container removably positioned adjacent said severing means for receipt of said individual pieces of engraved material.

22. The intaglio printing system of claim 21, wherein said storage container includes a plurality of compartments.

23. The intaglio printing system of claim 22, further including advancing means in alignment with each of said compartments opposing said severing means for advancing said individual pieces of engraved material within each of said compartments.

24. The intaglio printing system of claim 23, wherein said advancing means comprises a plurality of moveable plungers received within a base block supporting a cutting die counter having a plurality of aligned openings, said plungers moveable from a position within a respective said opening to a position within an aligned compartment of said storage container.

25. The intaglio printing system of claim 21, wherein said severing means includes a cutting die having at least one opening through which said individual pieces of engraved material pass into said storage container.

26. The intaglio printing system of claim 25, further including positioning means in association with said severing means for registering said web of material with said cutting die.

27. A continuous multi-station intaglio printing system comprising a hydraulic press having an intermittently movable ram at each of a plurality of engraving stations, supply means for supplying a continuous web of material successively to said hydraulic press at each of said plurality of engraving stations, intaglio printing means at each of said plurality of engraving stations in operative association with said ram for engraving said web of material at each said engraving station upon intermittent movement of said ram by operation of said hydraulic press, said intaglio printing means including first support means for removably supporting an engraving-die underlying said ram and second supporting means for removably supporting a die-counter in opposed spaced relationship to said engraving-die, application means for applying printing fluid to said engraving-die, wiping means for wiping excess printing fluid from said engraving-die, means for supplying a continuous web of wiper material for wiping excess printing fluid from said engraving-die, moving means coupled to said first support means for moving said engraving-die from a first position underlying said ram to a second position in operative association with said application means and said wiping means, and then to said first position between intermittent movement of said ram, a first pair of guides attached to said ram on either side of said first support means, said first pair of guides concurrently moveable with said movement of said ram, and a second pair of guides unattached to said first pair of guides fixedly positioned adjacent said application means and said wiping means in alignment with said first pair of guides, said second pair of guides remaining stationary during movement of said ram and said first pair of guides, the sides of said first support means engaging said first and second pair of guides for translational movement therealong in response to the operation of said moving means when said first pair of guides are in registration with said second pair of guides between intermittent movement of said ram, a take-up roll for said web of wiper material, a pair of nip rollers engageable on opposite sides of said web of wiper material for advancing said wiper material upon rotation of at least one of said rollers independent of the operation of said take-up roll, rotation means for rotating said at least one of said rollers, whereby a substantially constant length of said wiper material is paid out from said supply means during each operation of said rotation means independent of the diameter of said wiper material take-up on said take-up roll, and severing means for severing said web of material into individual pieces of engraved material.

28. The intaglio printing system of claim 27, wherein said first support means includes an engraving-die holder having a plurality of registration elements extending therefrom, said engraving-die including a plurality of openings for receiving said registration elements, whereby said engraving-die is aligned with said engraving die holder and, wherein said second support means includes a die-counter holder having a plurality of registration elements extending therefrom, said die-counter including a plurality of openings for receiving said registration elements, whereby said die-counter is aligned with said die-counter holder.

29. The intaglio printing system of claim 27, wherein said rotation means includes a gear coupled to said at least one of said rollers, a gear rack engaged with said gear, and advancing means for advancing said gear rack while engaged with said gear for rotation of said at least one of said rollers, and further wherein said take-up roll is coupled to said at least one of said rollers for concurrent rotation therewith.

30. The intaglio printing system of claim 27, further including a storage container removably positioned underlying said severing means for receipt of said individual pieces of engraved material.

31. The intaglio printing system of claim 30, wherein said storage container includes a plurality of compartments and said severing means includes a cutting die having at least one opening through which said individual pieces of engraved material pass into said compartments.

32. The intaglio printing system of claim 27, further including first positioning means in association with at least one of said plurality of engraving stations for registering said web of material with said intaglio printing means and second positioning means in association with said severing means for registering said web of material therewith.

33. A continuous intaglio printing method comprising advancing a continuous web of material to be engraved through a plurality of engraving stations, each of said plurality of engraving stations including a hydraulic press having an intermittently moveable ram and intaglio printing means in operative association with said ram for engraving a portion of said web of material, intermittently moving said ram by operation of said hydraulic press, applying printing fluid to said intaglio printing means, supplying a continuous web of wiper material for wiping excess printing fluid from said intaglio printing means, engaging a pair of nip rollers on opposite sides of said web of wiper material for advancement thereof upon rotation of at least one of said rollers, rotating said at least one of said rollers for advancing said wiper material, and coupling a take-up roll for said web of wiper material to said at least one of said rollers for concurrent rotation therewith for taking up said wiper material, the advancement of said web of wiper material being independent of the operation of said take-up roll whereby a substantially constant length of said wiper material is supplied for wiping excess printing fluid during each rotation of at least one of said nip rollers independent of the diameter of said wiper material taken up on said take-up roll.

34. The method of claim 33, further including applying printing fluid to said intaglio printing means and wiping excess printing fluid therefrom.

35. The method of claim 34, further including moving said intaglio printing means from a first position underlying said ram to a second position for application of printing fluid to said intaglio printing means and for wiping excess printing fluid therefrom and then to said first position between intermittent movement of said ram.

36. The method of claim 33, wherein said rotating includes coupling a gear to said at least one of said rollers, engaging a gear rack with said gear, and advancing said gear rack while engaged with said gear for rotation of said at least one of said rollers.

37. The method of claim 33, further including driving said take-up roll to maintain said web of wiper material taught.

38. The method of claim 33, further including intermittently advancing said continuous web of material to and from said plurality of engraving stations.

39. The method of claim 33, further including registering said web of material with said intaglio printing means.

40. The method of claim 33, further including severing said web of material into individual pieces of engraved material.

41. The method of claim 40, further including taking-up any residual portions of said web of material not forming said individual pieces of engraved material.

42. The method of claim 40, further including cutting up any residual portions of said web of material not forming said individual pieces of engraved material.

43. The method of claim 33, further including registering said web of material with a cutting die for cutting said web of material into individual pieces of engraved material.

44. A continuous intaglio printing apparatus comprising a hydraulic press having an intermittently moveable ram, supply means for supplying a continuous web of material to said hydraulic press, intaglio printing means in operative association with said ram for engraving said web of material upon intermittent movement of said ram by operation of said hydraulic press, said intaglio printing means including support means for removably supporting an engraving-die underlying said ram, application means for applying printing fluid to said engraving-die, supply means for supplying a continuous web of wiper material for wiping excess printing fluid from said engraving-die, a take-up roll for said web of wiper material, a pair of nip rollers engageable on opposite sides of said web of wiper material for advancing said wiper material upon rotation of at least one of said rollers independent of the operation of said take-up roll, and rotation means for rotating said at least one of said rollers whereby a substantially constant length of said wiper material is paid out form said supply means during each operation of said rotation means independent of the diameter of said wiper material taken up on said take-up roll.

45. The intaglio printing apparatus of claim 44, wherein said rotation means includes a gear coupled to said at least one of said rollers, a gear rack engaged with said gear, and advancing means for advancing said gear rack while engaged with said gear for rotation of said at least one of said rollers.

46. The intaglio printing apparatus of claim 45, wherein said take-up roll is coupled to said at least one of said rollers for concurrent rotation therewith, and drive means for driving said take-up roller to maintain said web of wiper material taught.

47. A continuous multi-station intaglio printing system comprising a hydraulic press having an intermittently moveable ram at each of a plurality of engraving stations, supply means for supplying a continuous web of material successively to said hydraulic press at each of said plurality of engraving stations, intaglio printing means at each of said plurality of engraving stations in operative association with said ram for engraving said web of material at each said engraving station upon intermittent movement of said ram by operation of said hydraulic press, said intaglio printing means including support means for removably supporting an engraving-die underlying said ram, application means for applying printing fluid to said engraving-die, supply means for supplying a continuous web of wiper material for wiping excess printing fluid from said engraving-die, a take-up roll for said web of wiper material, a pair of nip rollers engageable on opposite sides of said web of wiper material for advancing said wiper material upon rotation of at least one of said rollers independent of the operation of said take-up roll, and rotation means for rotating said at least one of said rollers whereby a substantially constant length of said wiper material is paid out from said supply means during each operation of said rotation means independent of the diameter of said wiper material taken up on said take-up roll.

48. The intaglio printing apparatus of claim 47, wherein said rotation means includes a gear coupled to said at least one of said rollers, a gear rack engaged with said gear, and advancing means for advancing said gear rack while engaged with said gear for rotation of said at least one of said rollers.

49. The intaglio printing apparatus of claim 48, wherein said take-up roll is coupled to said at least one of said rollers for concurrent rotation therewith for taking up said wiper material, and drive means for driving said take-up roller to maintain said web of wiper material taught.

* * * * *

UNITED STATES PATENT AND TRADEMARK OFFICE

CERTIFICATE OF CORRECTION

PATENT NO. : 5,195,435

DATED : March 23, 1993

INVENTOR(S) : Morrone, et al

It is certified that error appears in the above-indentified patent and that said Letters Patent is hereby corrected as shown below:

Abstract, line 3, "of" should read --or--.
Column 3, line 54, after "each" insert --of--.
Column 3, line 55, "station" should read --stations--.
Column 6, line 46, "With" should read --with--.
Column 9, line 50, "collinear" should read --co-linear--.
Column 9, line 52, "upper most" should read --uppermost--.
Column 10, line 24, "24" should read --240--.
Column 10, line 61, "taught" should read --taut--.
Column 10, line 66, "taught" should read --taut--.
Column 13, line 28, "11" should read --116--.
Column 17, line 13, "taught" should read --taut--.
Column 18, line 19, "taught" should read --taut--.
Column 20, line 59, "taught" should read --taut--.
Column 21, line 30, "form" should read --from--.
Column 22, line 2, "taught" should read --taut--.
Column 22, line 41 "taught" should read --taut--.

Signed and Sealed this

Eighteenth Day of January, 1994

*Attest:*

*Attesting Officer*

BRUCE LEHMAN

*Commissioner of Patents and Trademarks*